United States Patent [19]

Self

[11] Patent Number: 4,587,817

[45] Date of Patent: May 13, 1986

[54] HIGH SECURITY INTERNAL LOCKING SYSTEM

[75] Inventor: Henry L. Self, Oxnard, Calif.

[73] Assignee: The United States of America as represented by the Secretary of the Navy, Washington, D.C.

[21] Appl. No.: 614,493

[22] Filed: May 29, 1984

[51] Int. Cl.[4] ..... E05B 17/14

[52] U.S. Cl. ..... 70/427

[58] Field of Search ..... 70/427, 423, 424, 425, 70/426, 428, 455

[56] References Cited

U.S. PATENT DOCUMENTS 4,073,165 2/1978 Grundstrom ..... 70/371

4,142,390 3/1979 Schroeder ..... 70/371

FOREIGN PATENT DOCUMENTS 1054819 5/1979 Canada ..... 70/427

*Primary Examiner*—Robert L. Wolfe

*Attorney, Agent, or Firm*—Robert F. Beers; Joseph M. St.Amand; Thomas M. Phillips

[57] ABSTRACT

A locking system that consists of two locking mechanisms protected by a drill resistive shutter plate. The shutter plate can be rotated to expose a first lock which when unlocked allows it to be further rotated to uncover the second lock. Upon unlocking the second lock, the drive for the main bolt lock can then be actuated.

7 Claims, 6 Drawing Figures

HIGH SECURITY INTERNAL LOCKING SYSTEM

BACKGROUND OF THE INVENTION

The present invention relates to multiple lock control of a locking system and more particularly to an improved multiple lock control of a locking system which has a protective plate and a lock control of the boltwork drive mechanism.

The present method of locking large industrial doors is external mounted hardware consisting of some type of latching mechanism capable of being locked with an external padlock, or merely a hasp arrangement locked with a padlock. Because they are externally mounted these types of mechanisms offer little or no resistance to unauthorized forcible entry. There then is a need for an internal locking and boltwork drive mechanism for large hinged and rolling doors, known as industrial doors.

SUMMARY OF THE INVENTION

The present invention provides for a high security internal locking system for magazine doors and the like. Two locking mechanisms are provided and are protected by a drill resistive shutter plate and a boltwork drive mechanism. A first rotation of the shutter plate provides access to the shutter plate lock. Unlocking of this lock allows further rotation of the shutter plate to provide access to the primary lock. Unlocking of the primary lock permits the engagement of a driving cog to actuate the lock bolt.

Accordingly, an object of the invention is the provision of a high security internal locking system.

Another object of the invention is the provision of a high security internal locking system having two locking mechanisms protected by a drill resistive shutter plate and a lock controlled boltwork drive mechanism.

Other objects, advantages and novel features of the invention will become apparent from the following detailed description of the invention when considered in conjunction with the accompanying drawings wherein:

DESCRIPTION OF THE PREFERRED EMBODIMENT

Figure 1:
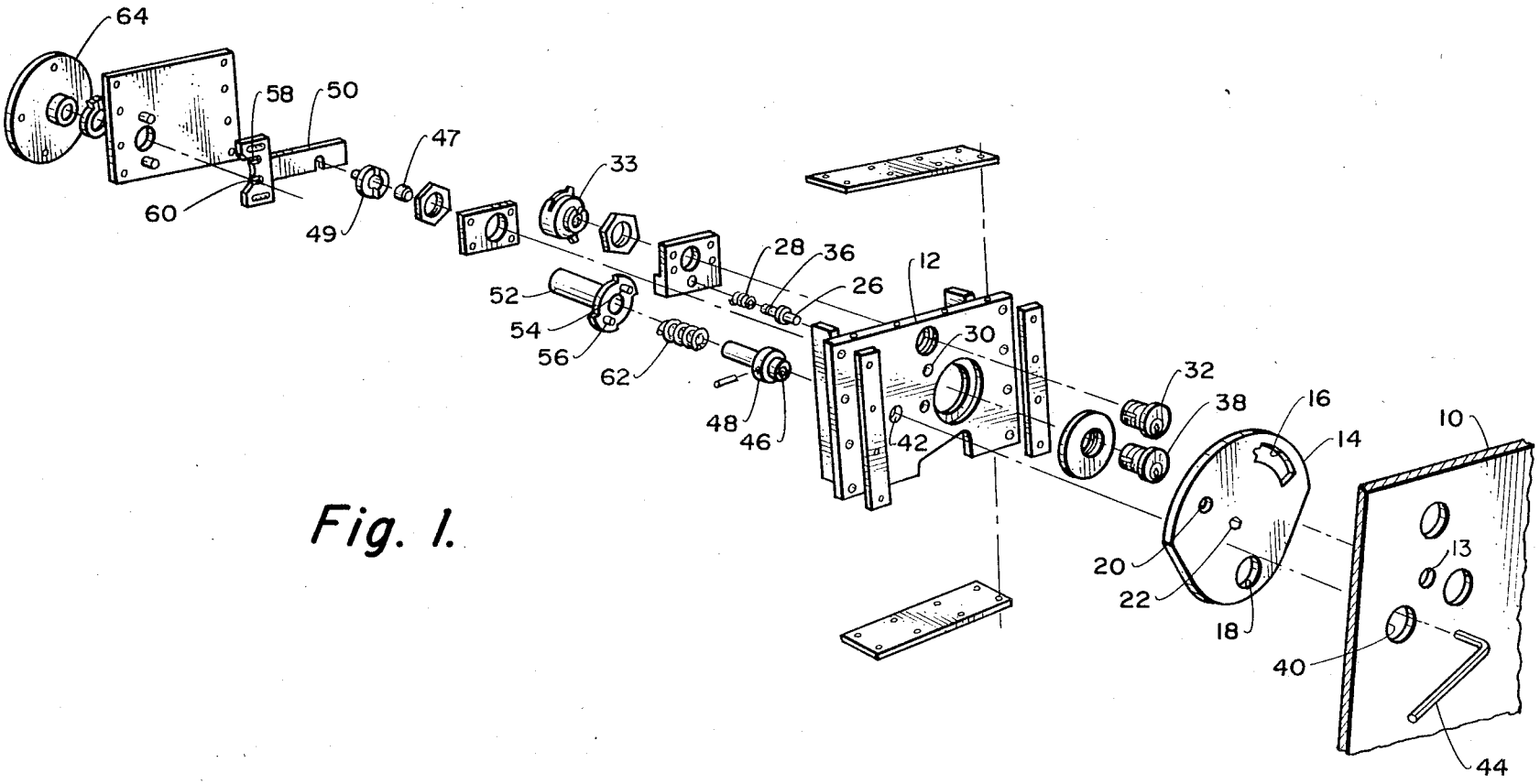
FIG. 1 is an exploded view of an embodiment of the invention.
Figure 2:
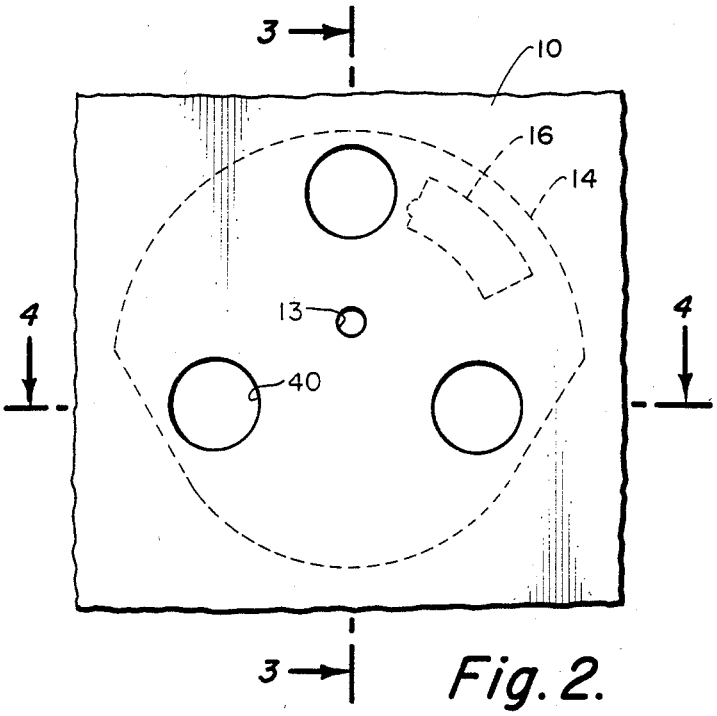
FIG. 2 is a front view of a door showing the arrangement of access openings of the locking system of FIG. 1.
Figure 3:
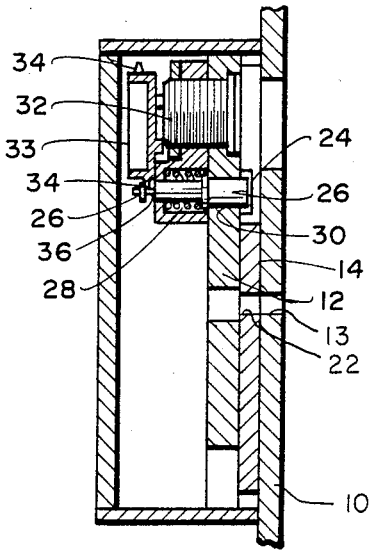
FIG. 3 is a cross-sectional taken along the lines 3—3 of FIG. 2 the shutter plate control lock.

As shown in the exploded view of FIG. 1, the lock assembly is mounted on the inside of a door 10. Between door 10 and front plate 12 there is mounted a shutter plate 14 with an elongated radial slot 16 and two round access apertures 18 and 20. Plate 14 has a key-way 22 for accepting a key through access aperture 13 in door 10 for rotation. As shown in FIG. 3, shutter plate 14 has a recess 24 facing front plate 12 into which pin 26 is held by means of spring 28. Pin 26 passes through hole 30 in front plate 12 to engage the recess 24 of plate 14.

Figure 6:
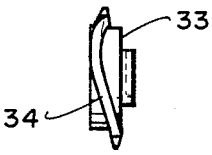
FIG. 6 is an enlarged side view of the cam 33 of FIG. 3.

When plate 14 is rotated counterclockwise, shutter lock 32 is exposed by elongated slot 16. When lock 32 is rotated, shutter lock cam 33 (FIG. 6) has a shoulder 34 that rides in groove 36 of pin 26 to pull pin 26 against spring 28 away from groove 24 in shutter plate 14. This then allows shutter plate 14 to be further rotated counterclockwise until primary lock 38 is exposed through hole 18. Also, hole 20 is aligned with hole 40 in door 10 and hole 42 in front plate 12. This allows tool 44 to be inserted in keyway 46 of drive cog 48.

Figure 4:
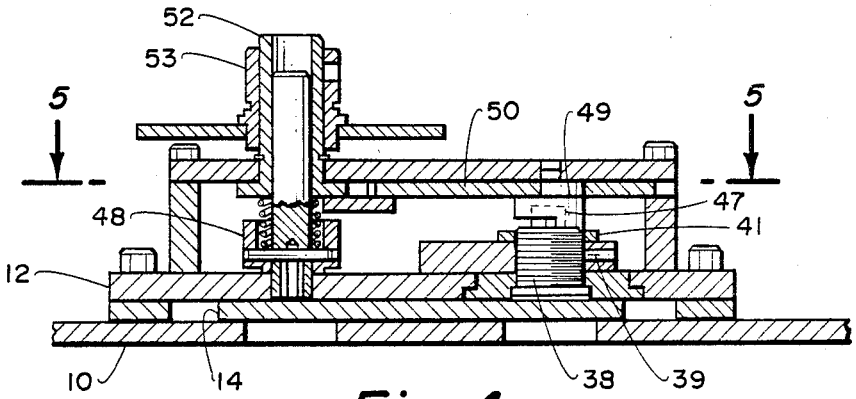
FIG. 4 is a cross-sectional view taken along the line 4—4 of FIG. 2 showing the lock controlling the boltwork drive mechanism.
Figure 5:
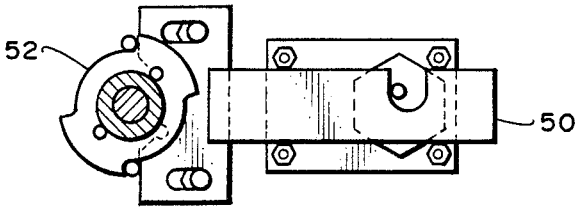
FIG. 5 is a view taken along the line 5—5 of FIG. 4 showing the detail of the slide bolt assembly.

Unlocking of primary lock 38 will withdraw primary lock bolt assembly 50. As shown in FIG. 4 when in the locked position primary lock bolt 50 (FIG. 5) performs two functions: (1) it separates drive cog 48 from cam sleeve 52, and (2) prevents rotation of cam sleeve 52. Pins 54 and 56 fit in slots 58 and 60, respectively, of bolt assembly 50. With the primary lock bolt in the unlocked position, tool 44 can then be inserted into keyway 46 of cog drive 48. Cog drive 48 can then be moved inward against spring 62 to engage cam sleeve 52. Rotation of drive cog 48 will cause rotation of cam sleeve 52 to which cam drive 64 is afixed. Rotation of drive cam 64 is used to operate a boltwork system (not shown) which firmly locks the door to a dooropening.

Obviously many modifications and variation of the present invention are possible in light of the above teachings. It is therefore to be understood that within the scope of the appended claims, the invention may be practiced otherwise than as specifically described.

What is claimed is:

1. In a high security internal locking system, the combination comprising:
   a. first and second locking mechanisms, adapted to be mounted on the inside of a door to be locked;
   b. driving cog lock bolt means controlled by said second locking mechanism for locking said door;
   c. a drill resistive rotatable shutter plate positioned in relation to said first and second locking mechanisms to protect them from tampering from outside the door;
   d. said shutter plate and said door each having aperatures that can be aligned;
   e. means for rotating said shutter plate to a first position to permit key access to said first locking mechanism;
   f. means responsive to unlocking said first locking mechanism to permit rotation of said shutter plate to permit key access to said second locking mechanism; and
   g. means responsive to unlocking said second locking mechanism to permit the engagement of said driving cog lock bolt means.

2. The high security locking system of claim 1 wherein said second locking mechanism includes a slide bolt positioned to prevent engagement of said driving cog when said second locking mechanism is in the locked position.

3. The high security locking system of claim 1 wherein said first locking mechanism includes a spring and pin arrangement for engaging a slot in said shutter plate to prevent further rotation of said shutter plate when in the locked condition.

4. The high security locking system of claim 3 wherein said first locking system further includes a cam having a shoulder that engages a groove in said pin to pull said pin against said spring to free said shutter plate for further rotation.

5. The high security internal locking system of claim 1 wherein said driving cog lock bolt means includes a driving cog for engaging a lock bolt drive cam sleeve and being held apart by a spring, a slide bolt assembly having a first position for preventing the engagement of said drive cam and said driving cog and preventing the rotation of said drive cam sleeve, said slide bolt assembly having a second position for allowing the engagement of said drive cam sleeve and said drive cog and freeing said drive cam sleeve for rotation.

6. The system of claim 5 wherein said first locking mechanism includes a spring and pin arrangement for engaging a recess in said shutter plate to prevent further rotation of said shutter plate when in the locked position.

7. The system of claim 6 further including a cam having a shoulder for engaging said pin to disengage said pin from said shutter plate to permit further rotation thereof.

* * * * *